US005980431A

United States Patent [19]

Miller, Jr.

[11] Patent Number: 5,980,431

[45] Date of Patent: Nov. 9, 1999

[54] MULTI-CYCLE

[76] Inventor: John Miller, Jr., 1348 Mar Del Dr., Greenville, Ohio 45331

[21] Appl. No.: 09/102,933

[22] Filed: Jun. 24, 1998

[51] Int. Cl.[6] ..... A63B 23/04

[52] U.S. Cl. ..... 482/57; 482/62

[58] Field of Search ..... 482/51, 57, 62, 482/63, 79, 1, 4, 110; 280/289 R

[56] References Cited

U.S. PATENT DOCUMENTS

| | | | |
|---|---|---|---|
| 583,920 | 6/1897 | Montgomery et al. . | |
| 3,216,722 | 11/1965 | Odom | 482/62 |
| 3,572,699 | 3/1971 | Nies . | |
| 3,917,261 | 11/1975 | Small et al. | 482/79 |
| 3,964,742 | 6/1976 | Carnielli . | |
| 4,113,043 | 9/1978 | Palmer | 280/289 R |
| 4,402,502 | 9/1983 | Peters | 482/62 |
| 4,402,503 | 9/1983 | Galbierz . | |
| 4,436,097 | 3/1984 | Cunningham | 482/63 |
| 4,705,269 | 11/1987 | DeBoer et al. . | |
| 4,846,156 | 7/1989 | Kopnicky . | |
| 5,035,419 | 7/1991 | Chen . | |
| 5,044,627 | 9/1991 | Huang . | |
| 5,050,865 | 9/1991 | Augspurger et al. | 482/63 |
| 5,338,272 | 8/1994 | Sweeney, III . | |
| 5,573,486 | 11/1996 | Beliakov . | |

*Primary Examiner*—Stephen R. Crow

*Attorney, Agent, or Firm*—Shlesinger, Arkwright & Garvey LLP

[57] ABSTRACT

An exercising apparatus comprising a stationary frame, a wheel rotatably mounted to the frame; a first drive unit mounted to the frame, a second drive unit mounted to the frame and operatively connected to the wheel and a first clutch mounted to the frame and being operatively connected to the first drive unit and being selectively engaged with or disengaged from the wheel.

17 Claims, 5 Drawing Sheets

MULTI-CYCLE

FIELD OF THE INVENTION

This invention relates generally to exercising apparatuses, and more particularly to stationary exercise cycles.

BACKGROUND OF THE INVENTION

Over the years, there have been numerous exercise cycles developed. These devices have included a stationary cycle having a frame, with flywheel or a sprocket, and hand and leg cranks, which are attached to the flywheel via continuous chains, whereby the rotation of the hand cranks will rotate the flywheel, which in turn will rotate the leg cranks, or vice versa. Examples of some these devices that have been developed in the past, and devices related thereto, are disclosed in the following patents:

U.S. Pat. No. 583,920, issued Jun. 8, 1897; U.S. Pat. No. 3,572,699, issued Mar. 30, 1971; U.S. Pat. No. 3,964,742, issued Jun. 22, 1976; U.S. Pat. No. 4,436,097, issued Mar. 13, 1984; U.S. Pat. No. 4,402,503, issued Sep. 6, 1983; U.S. Pat. No. 4,705,269, issued Nov. 10, 1987; U.S. Pat. No. 4,846,156, issued Jul. 11, 1989; U.S. Pat. No. 5,035,419, issued Jul. 30, 1991; U.S. Pat. No. 5,044,627, issued, Sep. 3, 1991; U.S. Pat. No. 5,338,272, issued Aug. 16, 1994; and, U.S. Pat. No. 5,573,486, issued Nov. 12, 1996.

However, these attempts have failed to provide a user of a stationary exercising cycle with the ability to selectively and separately engage and disengage two separate drive units, namely hand and leg cranks.

OBJECTS AND SUMMARY OF THE INVENTION

It is an object of the present invention to provide an exercise apparatus that is ergonomically designed and easy to utilize.

Yet another object of this invention is to provide an exercising apparatus having a means for exercising the upper body and the lower body of a user.

It is still a further object of this invention to provide an exercising apparatus that has rotating drive units that can independently and selectively rotate a wheel.

A further object of this invention is to provide an exercising apparatus that has a clutch, which can be selectively engaged or disengaged to allow a drive unit to either turn a wheel or to spin freely, respectively.

Yet another object of this invention is to provide a clutch that engages and disengages a resistance wheel to allow a leg crank to either rotate a resistance wheel or spin freely, respectively.

It is still a further object of this invention to provide an exercising apparatus having leg and hand cranks, which are extendable in their length to adjust to the size of a user and to adjust the amount of effort required to rotate the leg and hand cranks.

Yet another object of this invention is to provide an exercising apparatus having a resistance wheel, which applies an adjustable resistance to a flywheel.

A further object of this invention is to provide an exercising apparatus, which is inexpensive to manufacture.

In summary, the present invention discloses a novel configuration for an exercising apparatus, which includes a stationary frame, a wheel being rotatably mounted to the frame, a first drive unit being mounted to the frame, a second drive unit being mounted to the frame and operatively connected to the wheel and a first clutch mounted to the frame, with the first clutch being operatively connected to the first drive unit and being selectively adapted to engage or disengage the wheel.

These and other objects of the invention will be apparent from the following detailed description.

Relative terms such as left and right, up and down are illustrative only, and not intended to be limiting. The invention may be used by men, women and children, and the term "his" and "user" incorporates all such users.

DETAILED DESCRIPTION OF THE INVENTION

Figure 1:
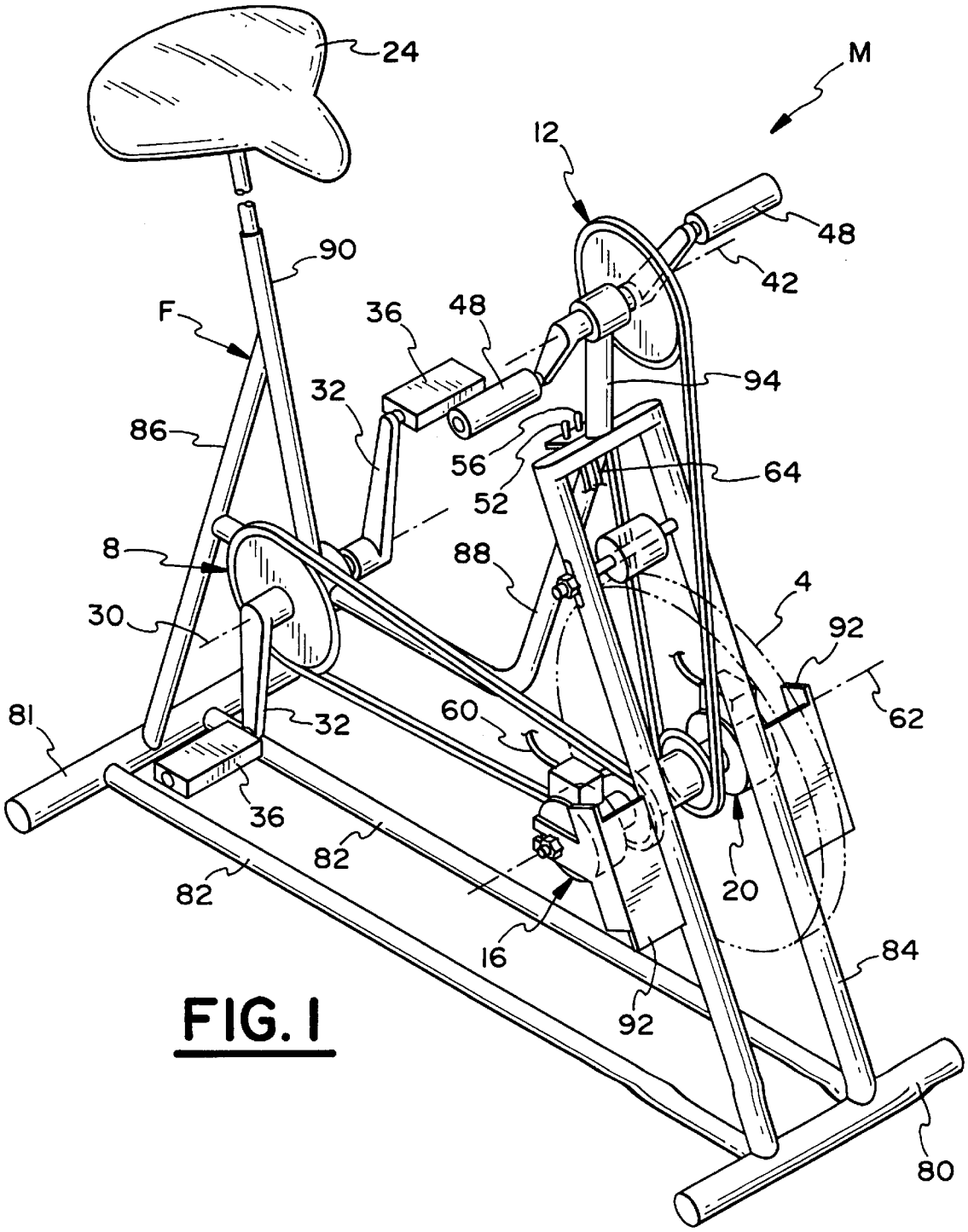
FIG. 1 is a left front isometric view of an exercising apparatus made in accordance with the present invention.
Figure 2:
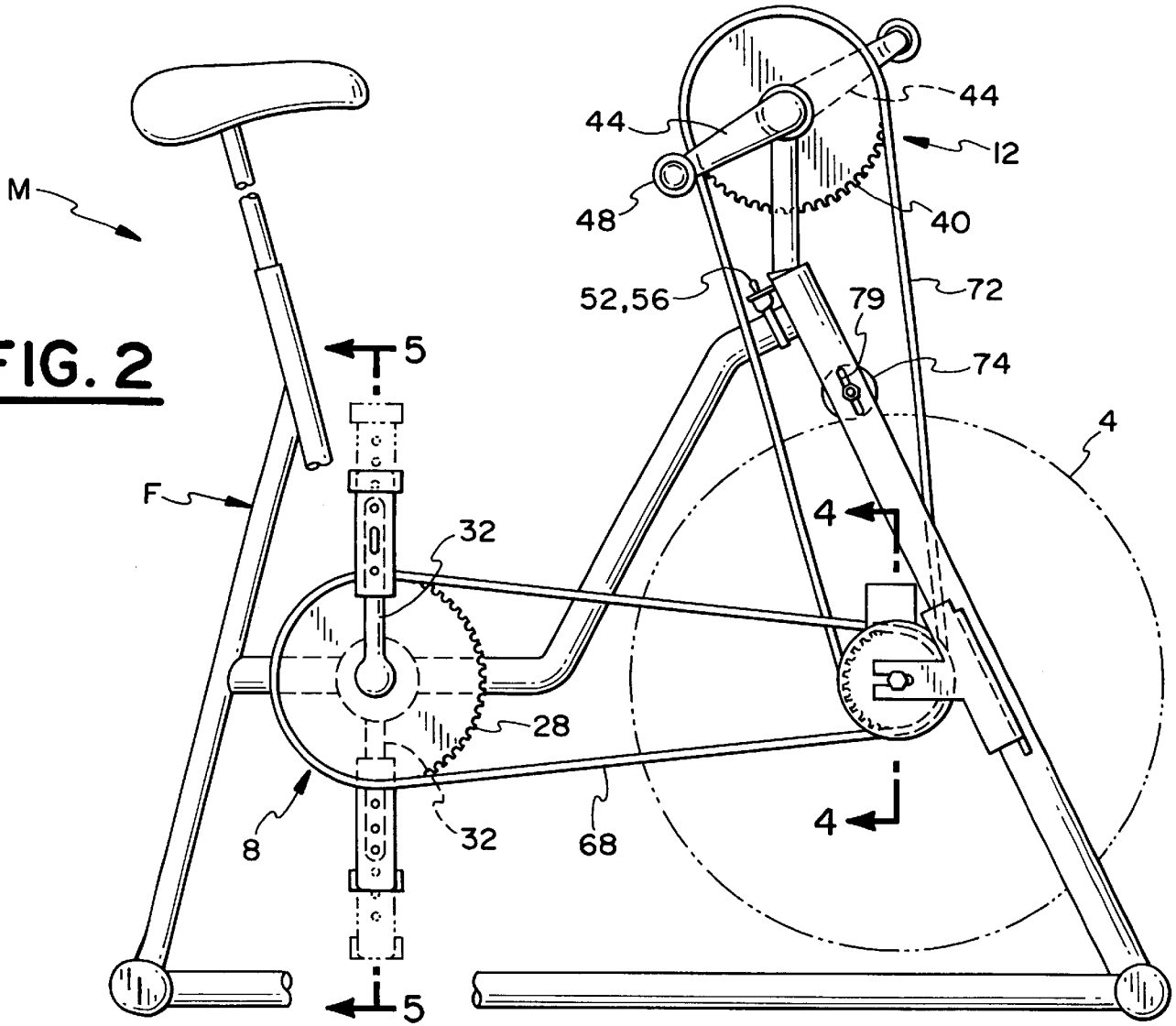
FIG. 2 is a left elevational view of the exercising apparatus of FIG. 1.
Figure 3:
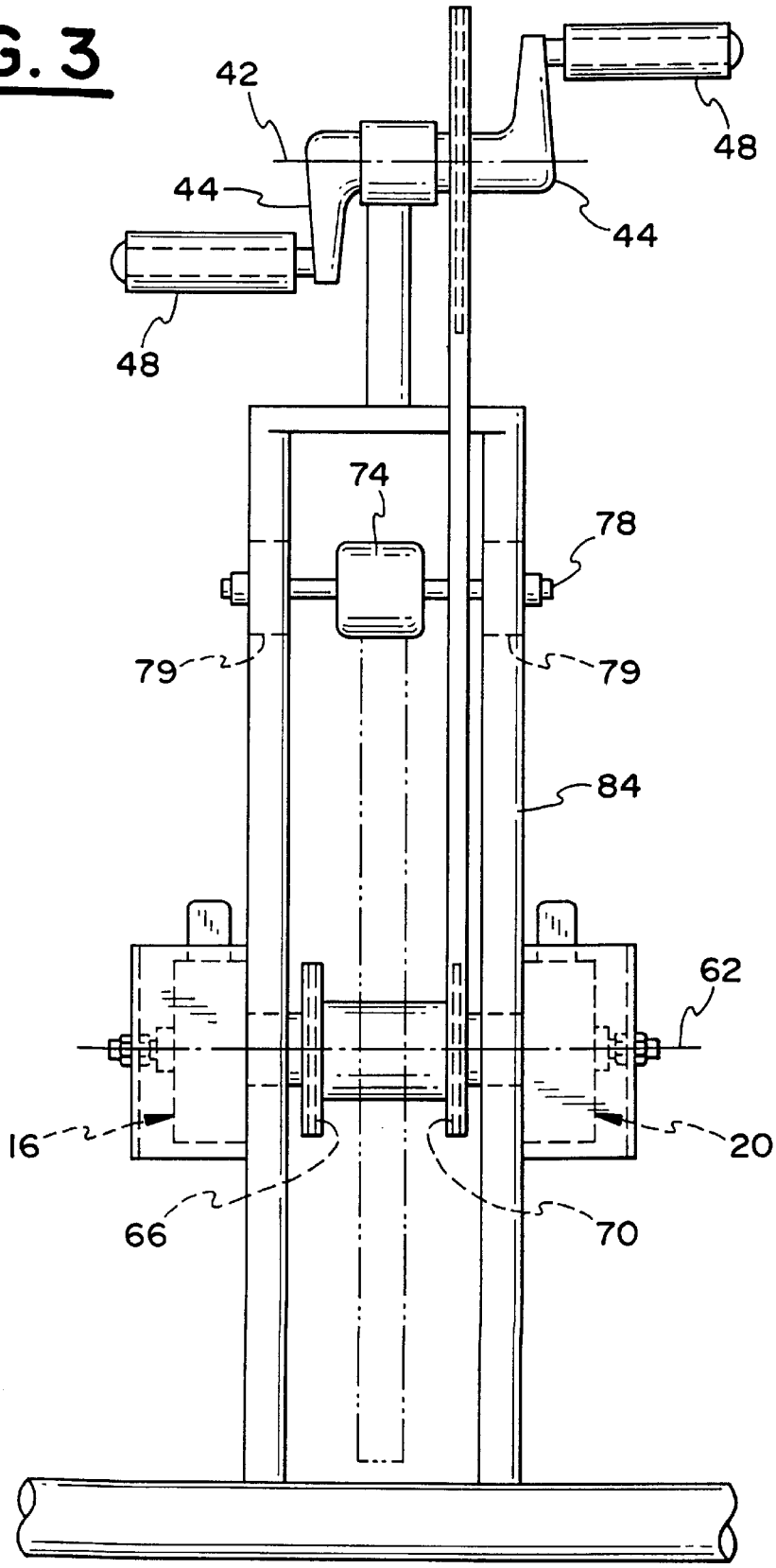
FIG. 3 is a front elevational view of the exercising apparatus of FIG. 1.

FIGS. 1, 2 and 3

Referring to FIGS. 1, 2 and 3, an exercising apparatus M, made in accordance with the present invention is shown. Exercising apparatus M is comprised of a frame F, a wheel or flywheel 4, a first drive unit 8, a second drive unit 12, and a first clutch 16. Exercising apparatus M, in a preferred embodiment also comprises a second clutch 20.

Exercising apparatus M and its operation, as will be discussed further below, provides users with the ability to select whether first drive unit 8 and second drive unit 12 will both rotate wheel 4, or if just one of units 8 and 12 will rotate wheel 4 or if neither will rotate wheel 4. An individual who may need physical rehabilitation to regain or rebuild muscular strength in either his/her legs or lower body areas, or his/her arms or general upper body areas, may utilize exercising apparatus M.

For example, a user may select both drive units 8 and 12 to rotate wheel 4 and use his/her stronger upper body to help strengthen an impaired leg, foot, knee, etc. Furthermore, a user of exercising apparatus M who is using a strong area of his body to assist an impaired area by exercising for a certain amount of time with both drive units 8 and 12 rotating wheel 4, may simply stop exercising the impaired part of his body by deactivating one of the drive units 8 or 12, while still exercising the stronger areas of his body. The structure and operation of exercising apparatus M, is discussed further below.

Frame F may be made of a steel tubular design. However, it is understood that many other various materials may be used in the manufacture and construction of frame F. Frame F has two base members 80 and 81. Connecting these two base members together are two parallel bottom spacers 82. Extending from base member 80, is a fork 84. Extending from base member 81 is a seat stay 86, and connecting seat stay 86 to fork 84 is a cross bar 88. Connected to cross bar 88 and seat stay 86 is a seat post 90. A Seat 24 attaches to seat post 90. Seat 24 may be any conventional seat. Seat 24 is preferred to be adjustable in its height. Frame F may further include clutch covers 92 and stem 94 that are attached to fork 84 and will be discussed further below.

First drive unit 8 includes a first sprocket 28. First sprocket 28 is attached to cross bar 88 such that it allows rotation first sprocket 28, similar to a common or conventional sprocket on a bicycle. First sprocket 28 rotates about a first horizontal axis of rotation 30. Two first cranks or moment arms 32 are mounted to first sprocket 28 on opposite sides thereof. First cranks 32 extend from first horizontal axis of rotation 30 in opposite directions, about 180 degrees apart from each other. Rotatably attached to first cranks 32 are pedals 36. Note, FIG. 2 displays an alternative embodiment for first cranks 32, which is further disclosed and discussed below in FIG. 5.

Second drive unit 12 is similar in arrangement to first drive unit 8. Second drive unit 12 includes a second sprocket 40 and is rotatably mounted to stem 94. Second sprocket 40 rotates about a second horizontal axis of rotation 42 and is mounted similar to first sprocket 28. Two second cranks or moment arms 44 are mounted to second sprocket 40 on opposite sides thereof. Second cranks 44 extend from second horizontal axis of rotation 42 in opposite directions, about 180 degrees apart from each other. Grips 48 may be rotatably attached to second cranks 44.

Attached to frame F is a first switch 52 for energizing or engaging first clutch 16. Also attached to frame F is a second switch 56 for energizing or engaging second clutch 20. First switch 52 and second switch 56 may be two position switches, in other words, they are either "on" or "off". An electrical wires 60 connects first clutch 16 to first switch 52. An electrical wires 64 connects second switch 56 to second clutch 20.

Wheel 4 may be a conventional bicycle wheel. Wheel 4 may include spokes, not shown. Wheel 4 may be of a solid configuration. Wheel 4 rotates about a third horizontal axis of rotation 62. Attached adjacent to wheel 4 are first clutch 16 and second clutch 20. Also adjacent to wheel 4 is a first driven sprocket 66 and a second driven sprocket 70. First and second driven sprockets 66 and 70 rotate about third horizontal axis of rotation 62.

A first belt or chain 68 engages first sprocket 28 and first driven sprocket 66, so that the rotation of the first sprocket 28 will rotate first driven sprocket 66. In a similar manner, a second belt or chain 72 engages second sprocket 40 and second driven sprocket 70, so that the rotation of the second sprocket 40 rotates second driven sprocket 70. First and second sprockets 28 and 66 include teeth around their outer periphery for engaging chain 68 and 72, respectively. First and second sprockets 28 and 66 may alternatively have a non-toothed outer periphery for engaging belts, rather than chains.

When first clutch 16 is engaged or energized, the rotation of first driven sprocket 66 will rotate wheel 4. Likewise, when second clutch 20 is engaged or energized, the rotation of second driven sprocket 70 will rotate wheel 4. It follows, that when both first clutch 16 and second clutch 20 are engaged or energized, the rotation of first driven sprocket 66 will rotate wheel 4 and second drive sprocket 70, and vice versa.

When either the first clutch 16 or the second clutch 20 are de-energized or disengaged, first driven sprocket 66 and second driven sprocket 70 respectively, will rotate freely about third horizontal axis of rotation 62 without rotating wheel 4. This is called "free-wheeling".

First clutch 16 is an electrical clutch. Second clutch 20 is an electrical clutch. It is understood that first clutch 16 and second clutch 20 may be non-electric.

Attached to frame F is a resistance wheel 74. Resistance wheel 74 may be a common wheel load resistance device. Resistance wheel 74 rotates about an axle 78. Axle 78 is disposed through and supported by slots 79, which are provided in fork 84. Resistance wheel 74 is disposed adjacent wheel 4 such that the rotation of wheel 4 will rotate resistance wheel 74. Resistance wheel 74 is adapted to adjust the friction between resistance wheel 74 and wheel 4, and thus vary the effort or force required to rotate wheel 4. The relative positional relationship between resistance wheel 74 and wheel 4 is adjusted by sliding axle 78 within slot 79.

FIG. 4

Figure 4:
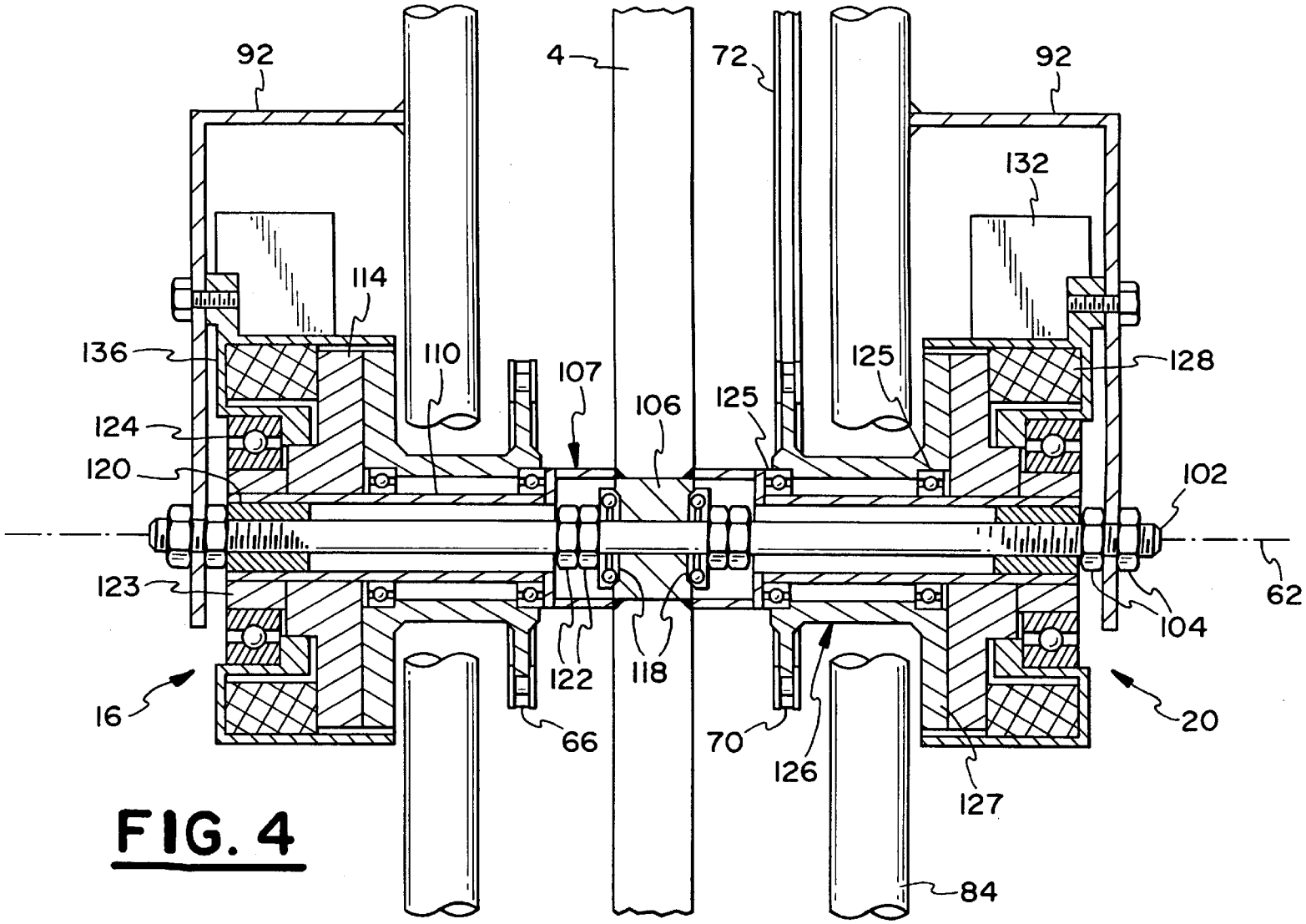
FIG. 4 is a partial cross-sectional view taken along the line 4—4 of FIG. 2.

FIG. 4 is taken along lines 4—4 of FIG. 2, and displays an enlarged partial cross sectional view of exercising apparatus M. FIG. 4 aids in the understanding of how first clutch 16 and second clutch 20 engage and disengage wheel 4.

First clutch 16 and second clutch 20 operate in a similar manner and contain the same elements and thus for the purposes of discussion and understanding, any reference to the elements of one clutch is considered to be reference to the elements of the other.

Extending from fork 84 are clutch covers 92. Mounted to clutch covers 92 is an axle 102; the center line of axle 102 is third horizontal axis of rotation 62. Axle 102 is attached to clutch cover 92 with nuts 104.

Wheel 4 is attached to wheel hub 107. Attached to wheel hub 107, is a rotor shaft 110 and attached to rotor shaft 110, is a rotor 114. Wheel hub 107, rotor shaft 110 and rotor 114 are fixed together and will rotate as one piece. The cross sectioning for wheel hub 107, rotor shaft 110 and rotor 114 are the same. Wheel hub 107, rotor shaft 110 and rotor 114 and are collectively called a rotor assembly 106.

Wheel bearings 118 and bushings 120 are disposed about axle 102 to allow the rotation of rotor assembly 106. Nuts 122 are disposed about axle 102 and adjacent wheel bearings 118 to contain wheel bearings 118. Nuts 122 maintain the axial positioning of wheel 4.

Disposed about rotor shaft 110 is spacer 123. Spacer 123 is fixed to rotor shaft 110 and rotates therewith. Disposed about spacer 123 is clutch ball bearing 124. Confining clutch ball bearing 124 is stationary field box 136, which is fixed to cover 92. Clutch ball bearing 124 provides smoother rotation of spacer 123 and rotor assembly 106 about third horizontal axis of rotation 62.

Disposed about rotor shaft 110 are bearings 125. Bearings 125 support sprocket and armature hub 126, which is disposed about rotor shaft 110. Bearings 125 provide smoother rotation of sprocket and armature hub 126 about rotor shaft 110. Sprocket and armature hub 126 includes either first driven 66 or second driven sprocket 70 and an armature 127.

The driven sprocket, either first driven sprocket 66 for clutch 16 or second driven sprocket 70 for clutch 20, is fixed to armature 127, so that they rotate as one unit. Thus, for purposes of clarity and understanding, sprocket and armature hub 126 has the same cross sectioning lines in FIG. 4.

Contained within stationary field box 136 and adjacent to rotor 114 is an electrical coil 128. Mounted to stationary field box 136 is an electric box 132. First clutch 16 and second clutch 20 are powered or energized by a small battery, not shown, which may be housed in electric box 132. Alternatively, a common household current (110–115 VAC) may be used to power clutches 16 and 20. Electric box 132 controls and allows the electric current from a power source to flow into coil 128.

As current flows through coil 128, in a particular direction, a magnetic field is created to either engage or disengage clutch 16 or 20. Using a coil to create a magnetic field for the engagement of a clutch is a common and generally understood practice.

When clutch 16 or 20 is engaged or energized, coil 128 will create a magnetic field that enables armature 127 to rotate in conjunction with rotor 114. When de-energized or disengaged, rotor 114 and armature 127 rotate independent of each other.

When either first clutch 16 or second clutch 20 is energized, the rotation of the driven sprocket, either first driven sprocket 66 or second driven sprocket 70, will rotate armature 127, which will in turn rotate rotor 114. Since rotor 114 is part of rotor assembly 106, when rotor 114 rotates, the entire rotor assembly 106 will rotate. Thus, wheel hub 107 will rotate upon the rotation of rotor 114.

Electric first clutch 16 and second clutch 20 are commercially available from several possible sources, with minor modifications thereto. The exact structural components of the clutches and their exact arrangement described herein are not required, so long as any clutch that is used allows a driven sprocket to rotate a wheel hub when the clutch is engaged and to rotate freely from the wheel hub when not the clutch is not engaged.

With the second switch 56 in the "on" position, second clutch 20 will be energized, linking rotor 114 to armature 127 for a simultaneous rotation thereof. In this position, the operator or user of exercising apparatus M can rotate second drive unit 12 with his hands. The rotation of second drive unit 12 will be transferred, via second belt or chain 72, to second driven sprocket 70, subsequently transferring the rotation to wheel 4.

In a similar manner, if first switch 52 is in the "on" position, first drive unit 8 can be rotated by the user's legs and that rotation will also rotate wheel 4.

When first switch 52 and second switch 56 are both in the "off" positions, the user may rotate the respective drive units 8 and 12 in a "free-wheeling" fashion and thereby exert little effort. First drive unit 8 and second drive unit 12 also provide stability for the user and provide for the user to rest his legs or hands, respectively.

If first switch 52 and second switch 56 are both in the "on" position, then the rotation of first and second drive units 8 and 12 will rotate wheel 4, as discussed above. With this arrangement, a user who is trying to rehabilitate a particular part of his body may use a strong area of his body to improve the impaired areas. For example, by rigorous hand pedaling of second drive unit 12, a user will rotate wheel 4 and force the rotation of first drive unit 8 to assist the recovery of a leg injury. Then, when it becomes desirable for the user to stop exercising the leg, first switch 52, which controls first clutch 16, may be turned to the off position by the user. The user could then continue to exercise his upper body areas while allowing his impaired leg or legs to rest. This arrangement may, of course be reversed so that the legs continue to exercise and the upper body is allowed to rest.

Although this invention has been shown in a preferred embodiment with two clutches providing the most versatility for a user, it is understood that only a single clutch may be employed. In other words, either first drive unit 8 or second drive unit 12 would not be attached to a clutch, only one of the drive units would. For example, an alternative exercising apparatus may be provided without first clutch 16. With only one clutch, first driven sprocket 66 would be attached to wheel hub 107 so that the rotation of driven sprocket 66 would rotate wheel 4. With this arrangement, second drive unit 12 may be selectively engaged or disengaged from the rotation of wheel 4 and the rotation of first drive unit 8 would always drive or rotate wheel 4.

FIG. 5

Figure 5:
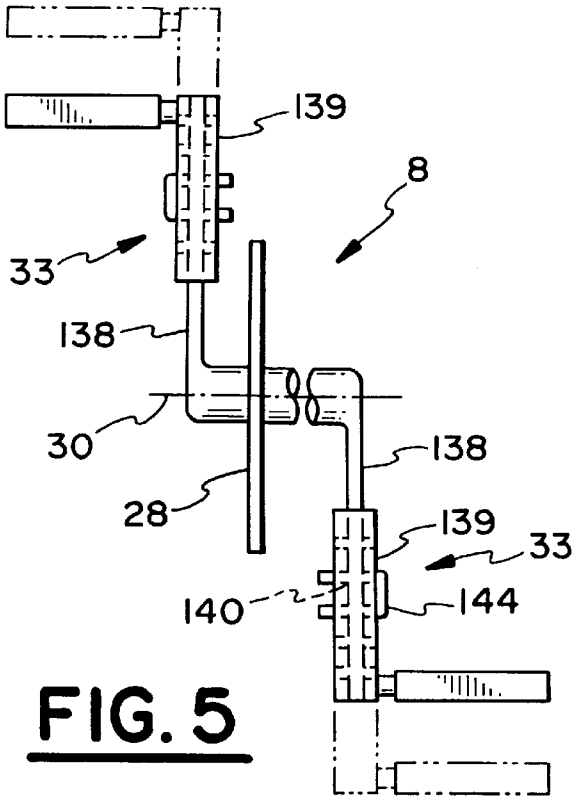
FIG. 5 is a sectional view taken along line 5—5 of FIG. 2.

FIG. 5 is a sectional view taken along line 5—5 of FIG. 2 2. The section lines or cross hatching of this figure have been removed for clarity. FIG. 5 displays an alternative embodiment of first drive unit 8. However, it is understood that this alternative embodiment can also be employed for second drive unit 12.

This alternative embodiment of first drive unit 8 illustrates the two alternative first cranks 33, which are attached to first sprocket 28 in the same manner as discussed above for first cranks 32. Alternative first cranks 33 are adjustable in their length.

Alternative first cranks include a main member 138 and a sliding member 139. A plurality of holes 140 are provided in main member 138 and sliding member 139. A clip 144 is provided to fit through holes 140 in main member 138 and sliding member 139. This arrangement will allow the adjustment of the length of alternative first cranks 33. Shown in phantom lines are cranks 33 in an extended position. Varying the length of alternative first cranks 33 allows utilization of exercising apparatus M by users of various sizes. Additionally, the length adjustment provides the user with ability to increase or decrease the amount of effort the user has to exert to turn wheel 4. If alternative first cranks 33 are shortened, more effort will be required to rotate wheel 4. If alternative first cranks 33 are lengthened, less effort will be required to rotate wheel 4.

FIG. 6

Figure 6:
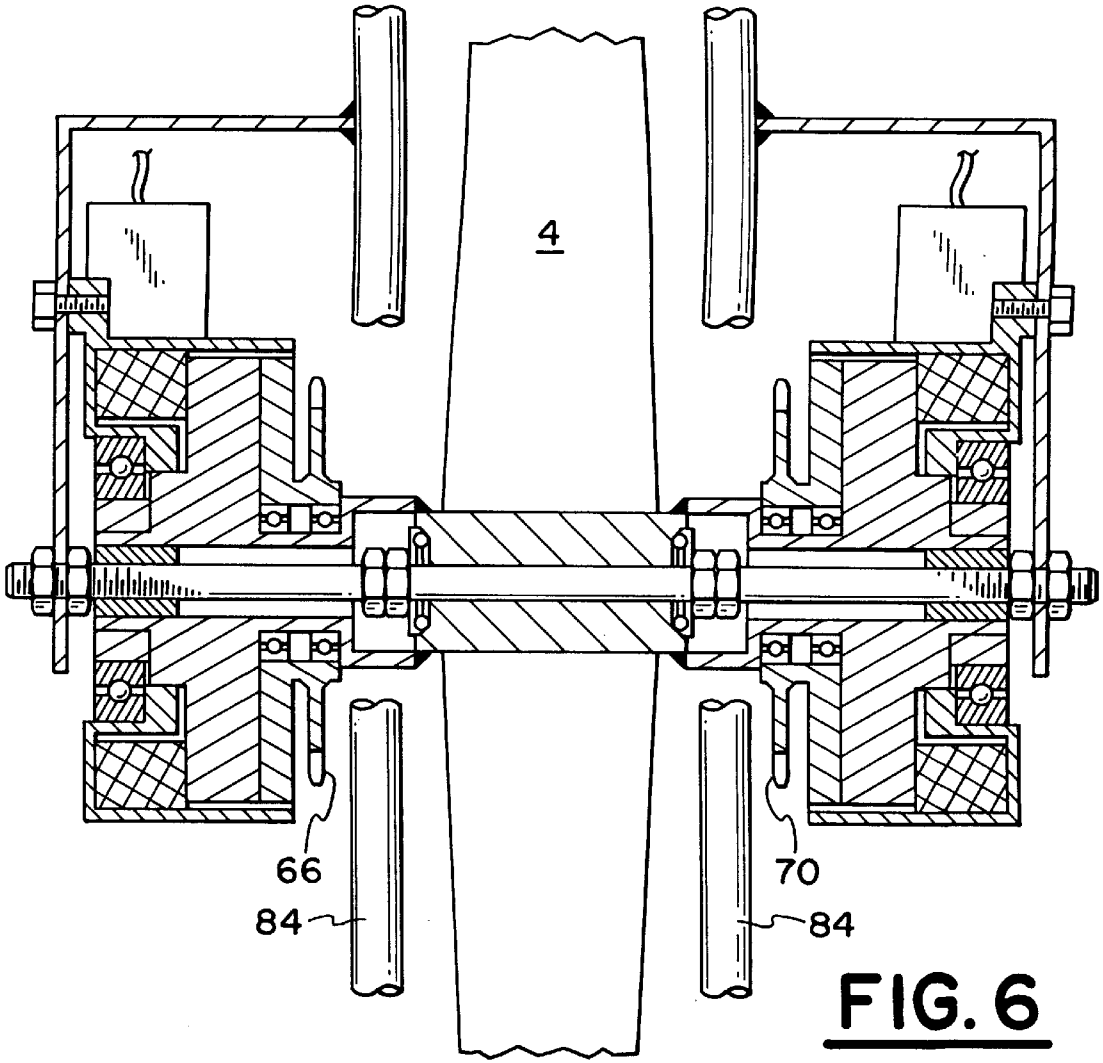
FIG. 6 is a partial cross-sectional view of an alternative embodiment of an exercising apparatus made in accordance with the present invention, that is similar to FIG. 4.

FIG. 6 displays an enlarged partial cross sectional view of an alternative embodiment of exercising apparatus M and is taken along line 4—4 of FIG. 2.

This alternative embodiment is similar to the embodiment shown in FIG. 4. First driven sprocket 66 and second sprocket 70 in this embodiment are spaced farther apart in relation to each other. Sprockets 66 and 70 are disposed outside the width of fork 84, whereas in FIG. 4, first driven sprocket 66 and second sprocket 70 are disposed within the width of fork 84.

The operation of the sprockets and clutches in connection with wheel 4, shown in FIG. 6, is identical to the operation and arrangement shown and described above for the embodiment displayed in FIG. 4.

A person of ordinary skill in the art will understand that the exercising apparatus of the present invention will provide a user with more versatility because of the ability to control whether separate drive units 8 and/or 12 turn wheel 4.

While this invention has been described as having a preferred design, it is understood that it is capable of further modification, uses and/or adaptations following in general the principal of the invention and including such departures from the present disclosure as come within known or customary practice in the art to which the invention pertains, and as may be applied to the essential features set forth, and fall within the scope of the invention or the limits of the appended claims.

I claim:

1. An exercising apparatus comprising:

a) a stationary frame;

b) a wheel being rotatably mounted to said frame;

c) a first drive unit being operatively connected to said wheel;

d) a second drive unit being operatively connected to said wheel such that said wheel is rotatable by said second drive unit in a clockwise and counterclockwise direction;

e) a clutch being operatively connected to said first drive unit and said wheel and having an engaged state and a disengaged state;

f) said clutch engages said first drive unit with said wheel in said engaged state such that rotation in a clockwise or a counterclockwise direction provided by said first drive unit is transmitted to said wheel and said second drive unit; and, g) said clutch disengages said first drive unit from said wheel in said disengaged state.

2. An exercising apparatus, as recited in claim 1, wherein:

a) said clutch is an electric clutch.

3. An exercising apparatus, as recited in claim 2, further comprising:

a) a switch provided for engaging or disengaging said clutch.

4. An exercising apparatus, as recited in claim 1, further comprising:

a) a first belt engaging said wheel and said first drive unit.

5. An exercising apparatus, as recited in claim 4, wherein:

a) said first drive unit includes moment arms, said moment arms being adjustable in length.

6. An exercising apparatus, as recited in claim 1, further comprising:

a) a second belt engaging said wheel and said second drive unit.

7. An exercising apparatus, as recited in claim 6, wherein:

a) said second drive unit includes second moment arms, said second moment arms being adjustable in length.

8. An exercising apparatus, as recited in claim 1, further comprising:

a) a wheel load device being disposed adjacent said wheel and operatively adapted to apply a resistance load to said wheel.

9. An exercising apparatus, as recited in claim 1, further comprising:

a) a seat disposed on said frame.

10. An exercising apparatus, as recited in claim 8, wherein:

a) said resistance load is variable.

11. An exercising apparatus comprising:

a) a stationary frame;

b) a wheel being rotatably mounted to said frame;

c) a first drive being operatively connected to said wheel;

d) a second drive being operatively connected to said wheel;

e) a first clutch being operatively connected to said first drive and said wheel and having an engaged position and a disengaged position, said first clutch engages said first drive with said wheel in said engaged position such that rotation in a clockwise or a counterclockwise direction provided by said first drive is transmitted to said wheel, said first clutch disengages said first drive from said wheel in said disengaged position; and, f) a second clutch being operatively connected to said second drive and said wheel and having an engaged position and a disengaged position, said second clutch engages said second drive with said wheel in said engaged position of said second clutch such that rotation in a clockwise or a counterclockwise direction provided by said second drive is transmitted to said wheel, said second clutch disengages said second drive from said wheel in said disengaged position of said second clutch.

12. An exercising apparatus as recited in claim 11, wherein:

a) said first clutch is an electric clutch.

13. An exercising apparatus as recited in claim 11, further comprising:

a) a switch provided for activating said first clutch.

14. An exercising apparatus as recited in claim 11, further comprising:

a) a belt operably engaging said wheel and said first drive.

15. An exercising apparatus as recited in claim 11, wherein:

a) said first drive includes moment arms, said moment arms being adjustable in length.

16. An exercising apparatus as recited in claim 11, further comprising:

a) a wheel load device being disposed adjacent said wheel and operatively adapted to apply a resistance load to said wheel.

17. An exercising apparatus as recited in claim 16, wherein:

a) said resistance load is variable.

* * * * *